US006411721B1

(12) United States Patent
Spindler

(10) Patent No.: US 6,411,721 B1
(45) Date of Patent: Jun. 25, 2002

(54) AUDIO SPEAKER WITH HARMONIC ENCLOSURE

(76) Inventor: William E. Spindler, 5306 Indiana Ave., Fort Wayne, IN (US) 46807

( * ) Notice: Subject to any disclaimer, the term of this patent is extended or adjusted under 35 U.S.C. 154(b) by 0 days.

(21) Appl. No.: 08/994,664

(22) Filed: Dec. 19, 1997

(51) Int. Cl.[7] ..... H04R 1/02

(52) U.S. Cl. ..... 381/349; 381/351; 181/153; 181/156

(58) Field of Search ..... 381/337, 345, 381/349, 351; 181/198, 199, 145, 196, 187, 189, 153, 156

(56) References Cited

U.S. PATENT DOCUMENTS

| | | | | |
|---|---|---|---|---|
| 1,741,274 A | | 12/1929 | Baumann | |
| 2,810,488 A | | 10/1957 | Van Dijck | 181/31 |
| 3,371,742 A | | 3/1968 | Norton et al. | 181/31 |
| 3,547,220 A | * | 12/1970 | Watson | 181/31 |
| 3,666,041 A | * | 5/1972 | Englehardt | 181/31 |
| 3,923,123 A | * | 12/1975 | Latimer-Sayer | 181/144 |
| 3,945,461 A | | 3/1976 | Robinson | 181/153 |
| 4,122,302 A | * | 10/1978 | Bobb | 181/145 |
| 4,164,988 A | | 8/1979 | Virva | 181/156 |
| 4,567,959 A | | 2/1986 | Prophit | 181/156 |
| 4,580,654 A | | 4/1986 | Hale | 181/146 |
| 4,592,444 A | | 6/1986 | Perrigo | 181/151 |
| 4,655,315 A | | 4/1987 | Saville | 181/153 |
| 4,756,382 A | | 7/1988 | Hudson, III | 181/156 |
| 4,872,527 A | | 10/1989 | Han | 181/160 |
| 4,924,962 A | | 5/1990 | Terai et al. | 181/141 |
| 5,197,103 A | * | 3/1993 | Hayakawa | 381/159 |
| 5,343,535 A | * | 8/1994 | Marshall | 381/159 |
| 5,471,019 A | * | 11/1995 | Maire | 181/156 |
| 5,525,767 A | * | 6/1996 | Fields | 181/155 |
| 5,721,401 A | * | 2/1998 | Sim | 181/148 |
| 5,824,969 A | * | 10/1998 | Takenaka | 181/156 |

FOREIGN PATENT DOCUMENTS

| | | |
|---|---|---|
| DE | 28 54 899 | 7/1980 |
| IT | 423291 | 7/1947 |

OTHER PUBLICATIONS

"A Non–resonant Loudspeaker Enclosure Design", A. R. Bailey, Wireless World, Oct. 1965.

"Transmission Line Low–Frequency Systems", Vance Dickason, The Loudspeaker Design Cookbook, Chap. 4, 1995.

"Cylindrical Symmetric Guitar TLs", Glenn DeMichele, Speaker Builder, 1/90.

"Loudspeakers in Vented Boxes: Part II", A.N. Thiele, Australian Broadcasting Commission, Journal of the Audio Engineering Society, 1971, vol. 19, No. 6.

"The Shortline: A Hybrid Transmission Line", John Cockroft, Speaker Builder, 1/88.

"The Unline: Designing Shorter Transmission Lines", John Cockroft, Speaker Builder, 4/88.

"A Prize–Winning Three–Way TL", Robert J. Spear and Alex Thornhill, Speaker Builder, 4/92, Part I.

"A Prize–Winning Three–Way TL", Robert J. Spear and Alex Thornhill, Speaker Builder, 5/92, Part II.

"A Compact Integrated Electrostatic/Transmission Line", Roger R. Sanders, Speaker Builder, 3/90, Part III.

(List continued on next page.)

*Primary Examiner*—Forester W. Isen
*Assistant Examiner*—Brian Pendleton
(74) *Attorney, Agent, or Firm*—Baker & Daniels

(57) ABSTRACT

The present invention involves a speaker system for sound reproduction. A low frequency transducer is mounted in one end of the elongated speaker enclosure, and the other end of the enclosure is at least partially open. The speaker enclosure is completely open, i.e., without stuffing, and is dimensioned such that the length of the internal chamber is about one-eighth the length of the wavelength of the lowest frequency sounds to be produced by the transducer.

30 Claims, 13 Drawing Sheets

OTHER PUBLICATIONS

"The Use of Fibrous Materials in Loudspeaker Enclosures", L.J.S. Bradbury, Journal of the Audio Engineering Society, Apr. 1976, vol. 24, No. 3.
"Cabinets", G.A. Briggs, Chapter 18, Loudspeakers.
"The Transmission–line Loudspeaker Enclosure", A.R. Bailey, Wireless World, May 1972.
"Transmission Line Speaker", J. Theodore Jastak, The Audio Amateur, Issue 1,1973.

* cited by examiner

AUDIO SPEAKER WITH HARMONIC ENCLOSURE

BACKGROUND OF THE INVENTION

1. Field of the Invention

The present invention relates to sound reproduction systems. More particularly, the field of the invention is speaker enclosures for such audio reproduction systems.

2. Description of the Related Art

Sound reproduction systems are well known, and typically include a generation circuit (e.g., a radio receiver or a compact disc player), an amplification circuit (for amplifying the signal from, e.g., the radio or disc player), and a speaker consisting of one, two, or three, etc., transducers; a typical three-way speaker system consisting of high frequency transducers (tweeter, HF), a mid-range transducer (middle range frequencies, MF), and a low frequency transducer (woofer, LF). Various arrangements are known for speaker designs for each of these types of transducers, and the speaker design may be specially constructed to benefit the audio band which the transducer produces. In particular, low range transducers (woofers) are well known to include a cone diaphragm (typically 4" to 30") which vibrates according to the signal received by the transducer. The diaphragm may be conically shaped, and while air on one side of the diaphragm is compressed, air on the opposite side of the diaphragm is rarified. This results in the sound resonating from one side of the transducer being 180° out of phase with sound resonating from the other side of the transducer. In order to separate the compressed air from the rarefied air, a low frequency transducer must be placed in an enclosure designed to isolate its front radiations from rear radiations. There are many such configurations.

One of the simplest is a circular baffle with the transducer mounted in the center. This configuration requires a baffle approximately 40 feet in diameter to produce bottom A on a piano or 27.5 Hz.

A large sealed enclosure with the transducer mounted in such a manner as to isolate the transducer front radiation from its rear radiation is known as an infinite baffle. Large infinite baffles produce good low range sound but are relatively large and only utilized one side of the mounted low frequency transducer.

An infinite baffle cabinet can be reduced in size by adding a vent or port. This configuration is known as a reflex cabinet or vented box and produces low frequency more efficiently and with better impedance match to an amplifier than the infinite baffle but does not produce low frequency sound as "open" as the above baffle.

To achieve a more open sound and a good impedance match to an amplifier, a cabinet configuration referred to as an acoustic labyrinth can be employed.

An acoustic labyrinth is a pipe or duct, folded to conserve space, and connected to the rear of the transducer cone. The far end of the duct is left open and in the same plane as the transducer. The pipe is arranged to be a quarter wavelength at some low frequency near to the resonant frequency of the loudspeaker when loaded by the labyrinth. Around this frequency, the transmission delay along the pipe brings the energy radiated from the open end approximately in phase with the front radiation on the unit. The low frequency range of the system is therefore reinforced, and since the transducer is looking into a high impedance when the pipe is a quarter wavelength, cone excursions are much reduced, resulting in less non-linear distortion. A loudspeaker with a loaded resonance at 40 Hz would require a duct 7' long. At frequencies below the quarter wavelength mode, the port and diaphragm radiation are out of phase and the response falls off steeply. At higher frequencies, the port radiation would be in and out of phase according to wavelength, and would tend to produce irregular response characteristics in the middle registers; sound absorption is therefore necessary.

The labyrinth actually lowers the frequency of cone resonance owing to the mass of air in the duct which operates directly on the cone surface. As enclosures go, it produces very good bass. G. A. Briggs, *Loudspeakers*, Wharfedale Wireless Works Limited, 1948, Chap. 18, "Cabinets", p. 191.

The transmission line (TL) has its design roots in the Stromberg-Carlson acoustic labyrinth (circa 1930). It first consisted of a long pipe (open at one end and the driver mounted at the other), with a cross-sectional area about the same as that of the driver. The line length was made about 25% of the driver resonance's wavelength and then folded to make it into a practical shape. Without any stuffing or damping material in the line, the enclosure dampened output at resonance, and reinforced the frequencies about one octave above resonance.

Working with the same basic concept in the early 1960's, A. R. Bailey experimented with different damping materials and techniques in folded labyrinth lines. A. R. Bailey, "A Non-Resonant Loudspeaker Enclosure Design",*Wireless World*, October 1965; T. Jastak, "A Transmission Line Speaker",*Audio Amateur*, January 1973;. A. R. Bailey, "The Transmission Line Loudspeaker Enclosure", *Wireless World*, May 1972. This work has since become the basic bible for most TL designs. Using Bailey's density criteria of 0.5 lb. cu. ft., A. J. Bradbury published his 1976 paper (A. J. Bradbury, "The Use of Fibrous Materials in Loudspeaker Enclosures", *JAES*, April 1976) which described changes in the speed of sound for different types of damping material (fiberglass and long fiber wool). Vance Dickason, *The Loud Speaker Design Cookbook*, Audio Amateur Press, Peterborough, N.H., 1995, Chap. 4, "Transmission Line Low-Frequency Systems", p. 73.

Transmission lines are enclosures filled with a sound absorbing material, such as long fiber Dacron wool, in order to delay the low frequency acoustic waves so that the transducer compression and rarefactions are in phase, i.e., that cancellation does not occur. Packing the enclosure with sound delaying and absorbing material (equal to 0.5 lb. cu. ft. of wool or more) produces an undesirable acoustic result by dramatically reducing the "openness" of the bass sound.

SUMMARY OF THE INVENTION

The present invention is a speaker system which has an enclosure about one-eighth of the length of the lowest frequency sound which one wants to produce using a transducer.

$$\text{wavelength} = \frac{\text{speed of sound in air}}{\text{desired frequency } (c/s)}$$

$$\text{cabinet length} = \frac{\text{wavelength}}{8}$$

The enclosure defines an interior space having two ends, one end mounting the speaker and the other end having an opening which allows the rearward directed sound waves to escape. The sound produced by the interior side of the speaker travels for one-eighth of a wavelength of the sound to be produced to the opening, and travels an additional one-eighth of a wavelength to the front side of the speaker so that the sound is in phase with the sound waves produced by the exterior face of the transducer. The interior channel of the enclosure of the present invention is open (i.e. not obstructed by excessive sound delaying stuffing) to provide a high quality, life-like "open" bass sound. Tweeters and mid-range speakers may also be accommodated within the speaker enclosure by including a layer of sound absorbing material on the interior wall or walls of the enclosure or utilizing fibrous material at such a density (less than 0.5 lb. per cu. ft.) that low frequencies (approximately 150 cps or less) are not absorbed or isolating them in separate small cabinets within the main enclosure. The enclosure may have a cross-sectional shape of circle, triangle, square, rectangle, trapezoid, pentagon, hexagon, heptagon, octagon, other polygons, etc., and may be disposed horizontally or vertically. A conically shaped baffle may be used to distribute the rearwardly transmitted sound out of the speaker enclosure, and is particularly useful with vertically disposed speaker enclosures. Further embodiments of the present invention include providing two or more transducers mounted in oppositely directed chambers. A transducer mounted at one end of an enclosure having internal baffles which create a serpentine path for sound, a transducer mounted in the center of an enclosure and other variations. The present invention provides a sound path from the transducer to the enclosure opening having a distance of approximately one-eighth of the wavelength of the low frequency sound to be produced. The sound escaping through the opening thus will be in phase when it reaches the front of the speaker, thereby utilizing 100% of both sides of the woofer and at the same time creating a full and open bass sound. By taking advantage of phase reinforcement, the efficiency of the speaker is increased because the sound energy from the interiorly facing side of the transducer diaphragm is effectively combined with the sound energy emanating from the exteriorly facing side of the speaker diaphragm. Also, this produces a flatter impedance curve which results in a better transducer match to the amplifier output. The present invention thus has a greater power handling capability because of its increased efficiency and matching with the amplifier output.

Conventional cross-over circuits are utilized to limit the frequency of the sound produced by the bass transducer to a low level, for example below 150 hertz or, preferably, below 75 hertz. If a mid-range transducer and/or tweeter are disposed within the enclosure so that higher frequency sounds are transmitted through the interior channel of the enclosure, means are provided for absorbing these higher frequency standing waves. One such technique is to line the interior wall or walls of the enclosure with sound absorbing material. However, it is critically important that the channel itself remain an open cross-section area and should not be less than approximately 25% of the woofer's effective cone radiating area so that the low frequency acoustic waves can travel rearwardly through the channel and out the opening without being damped or delayed. This combination of high frequency attenuation and completely unobstructed transmission of the low frequency acoustic waves produces the high quality open bass sound that is characteristic of the present invention. The present invention involves, in one form, a speaker system for the reproduction of low frequency sounds. The speaker system comprises a low frequency transducer for reproducing sounds in a low frequency band, a filter, and an elongated enclosure. The filter provides signals for reproducing sound which does not exceed 150 hertz in frequency, and is connected to the transducer and is adapted for connection to the audio system. The enclosure has an interior channel having two ends. The low frequency transducer is mounted at one end and has a front vibrating surface facing exteriorly and a rear vibrating surface facing interiorly. The other end has an opening adapted to allow sounds produced by the speaker to escape the interior space. The distance between the speaker and the opening is approximately one-eighth the length of the wavelength of the lowest frequency sound to be produced by the speaker.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
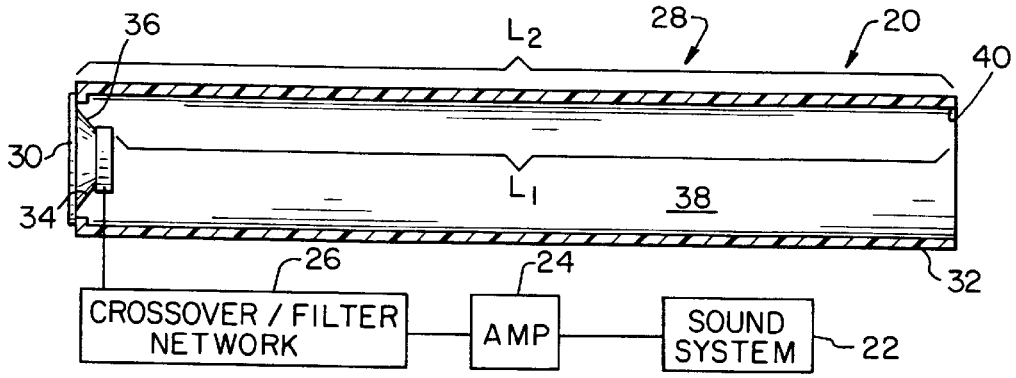
FIG. 1 is a schematic view of the present invention.

Corresponding reference characters indicate corresponding parts throughout the several views. The exemplifications set out herein illustrate preferred embodiments of the invention, in several forms, and such exemplifications are not to be construed as limiting the scope of the invention in any manner.

DESCRIPTION OF THE PREFERRED EMBODIMENTS

Figure 2:
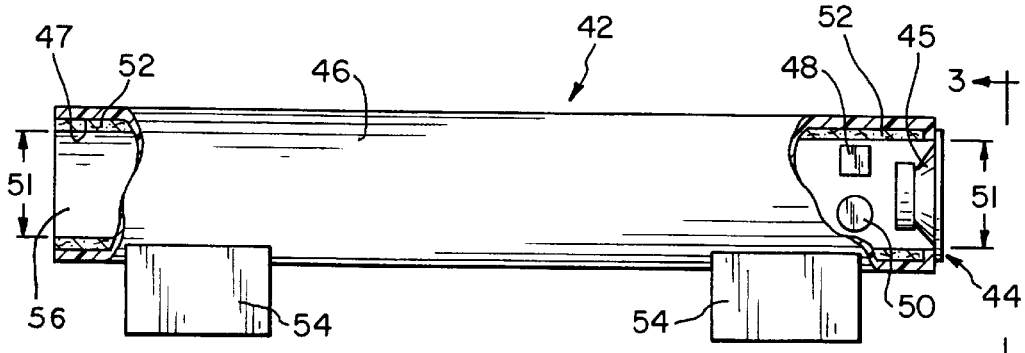
FIG. 2 is a side elevational view, in partial cutaway, of a first embodiment of the present invention.
Figure 3:
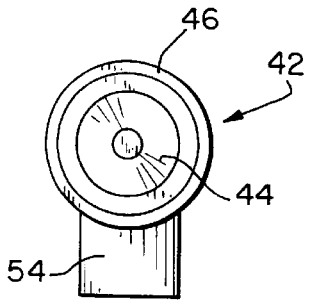
FIG. 3 is a front view taken along view line 3—3 of FIG. 2.

The present invention is illustrated in schematic form in FIG. 1. Sound reproduction system 20 includes sound system 22, amplifier 24, cross-over or low pass filter 26, and audio transducer 30 (e.g. a conventional speaker). Sound system 22 may be a radio receiver, a phonograph player, a tape player, a compact disc player, or other sound signal generating device. Amplifier 24 receives the sound signals generated by sound system 22 and amplifies them for reproduction by transducer 30. Filter 26 connects amplifier 24 and transducer 30, and prevents sound signals for frequencies greater than a predetermined amount from reaching transducer 30. For example, low pass filter 26 may prevent signals representing sound of greater than 150 hertz from reaching transducer 30. Low pass filter 26 may also have a cut-off value of 100, 75 or 50 hertz, etc. In accordance with the present invention, speaker unit 28 comprises transducer 30 and enclosure 32. Transducer 30 is a conventional low frequency transducer having a diaphragm with an exteriorly facing surface 34 and an interiorly facing surface 36. Transducer 30 is mounted at one end of enclosure 32, which defines interior space or duct 38 within its walls, and includes opening 40 at the other end. Enclosure 32 is structured and arranged so that the distance from interiorly facing surface 36 to opening 40, labeled as L1 in FIG. 1, is about one-eighth the length of the wavelength of the lowest sound to be generated by transducer 30, for example, 27.5 hertz, which is low A on a piano. Further, the distance from opening 40 to exteriorly facing surface 34, labeled as L2 in FIG. 1, is also about one-eighth the length of the wavelength of the sound being generated by transducer 30. Therefore, sound emanating from interiorly facing surface 36 travels one-fourth of its wavelength (L1+L2) to reinforce sound emanating from exteriorly facing surface 34. FIGS. 2 and 3 show a cylindrical embodiment of the present invention. Speaker unit 42 includes low frequency transducer 44, cylindrical enclosure 46, mid-range transducer 48, tweeter 50, a layer of high frequency sound absorbing material 52, and two supports 54. Transducer 44 is mounted at one end of enclosure 46, and opening 56, which is preferably at least as large in cross-sectional area as speaker cone 45 (as indicated by arrows 51), is present at the other end of enclosure 46. The cylindrical shape of enclosure 46 is advantageous in that the creation of standing waves off parallel surfaces is minimized. Mid-range transducer 50 and tweeter 48 are disposed within enclosure 46 along with sound absorbing material 52 which absorbs sound from mid-range transducer 50 and tweeter 48 which passes through the interior of enclosure 46.

A layer of sound absorbing material 52, such as Dacron wool or fiberglass, is disposed on the inner surface 47 of enclosure 46. Supports 54 are in the form of blocks having a cylindrically shaped depression to receive the exterior surface of enclosure 46.

Figure 4:
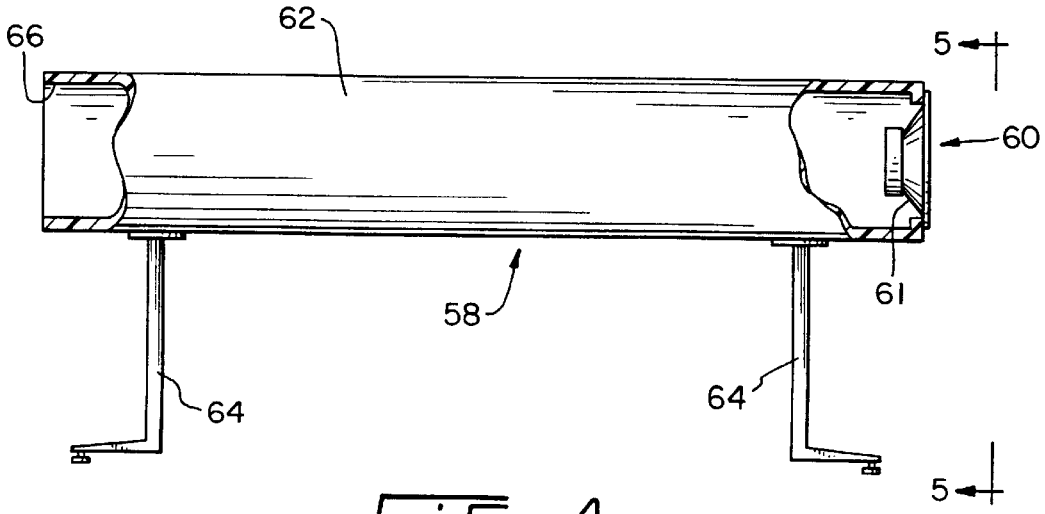
FIG. 4 is a side elevational view, in partial cutaway, of a second embodiment of the present invention.
Figure 5:
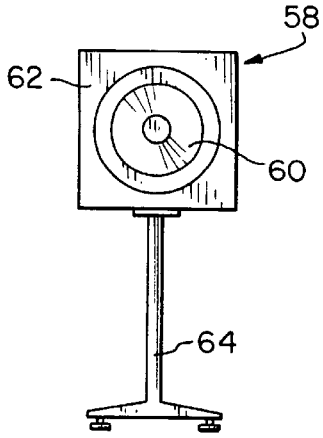
FIG. 5 is a front view taken along view line 5—5 of FIG. 4.

FIGS. 4 and 5 show a rectangular embodiment of the present invention. Speaker unit 58 includes low frequency transducer 60, rectangular enclosure 62, and two supports 64. Enclosure 62 acoustically mounts transducer 60 at one end and has opening 66 located at its other end which can vary in size to say ½ cone area of said transducer. Supports 64 have an upper member attached to enclosure 62 and a lower member adapted to be located on a flat surface.

Figure 6:
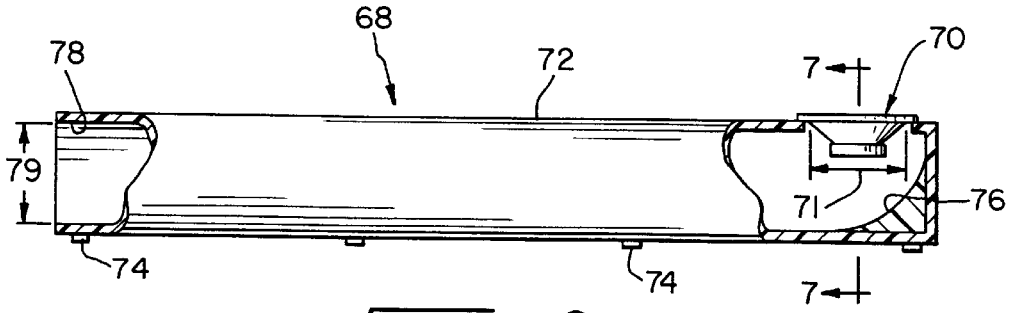
FIG. 6 is a side elevational view, in partial cutaway, of a third embodiment of the present invention.
Figure 7:
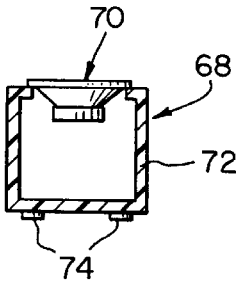
FIG. 7 is a sectional view taken along view line 7—7 of FIG. 6.

FIGS. 6 and 7 show a horizontally oriented, upwardly facing embodiment of the present invention. Speaker unit 68 includes low frequency transducer 70, enclosure 72, and eight supports 74. Horizontally disposed enclosure 72 acoustically mounts transducer 70 at its upper surface at one end with a curved reflecting surface 76 disposed under transducer 70 to reflect sound to the other end of enclosure 72 where opening 78 is located. Supports 74 are small blocks arranged in a rectangular pattern and which extend from the lower surface of enclosure 72. The cross-sectional area of opening 78 represented by arrow 79 can be as large as the effective cross-sectional area of the cone of transducer 70, which is represented by arrow 71.

Figure 9:
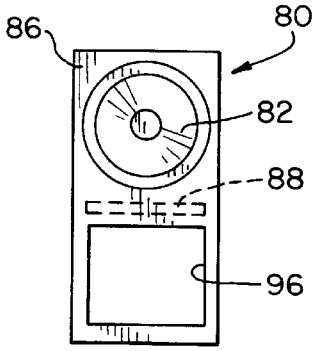
FIG. 9 is a front view taken along view line 9—9 of FIG. 8.
Figure 8:
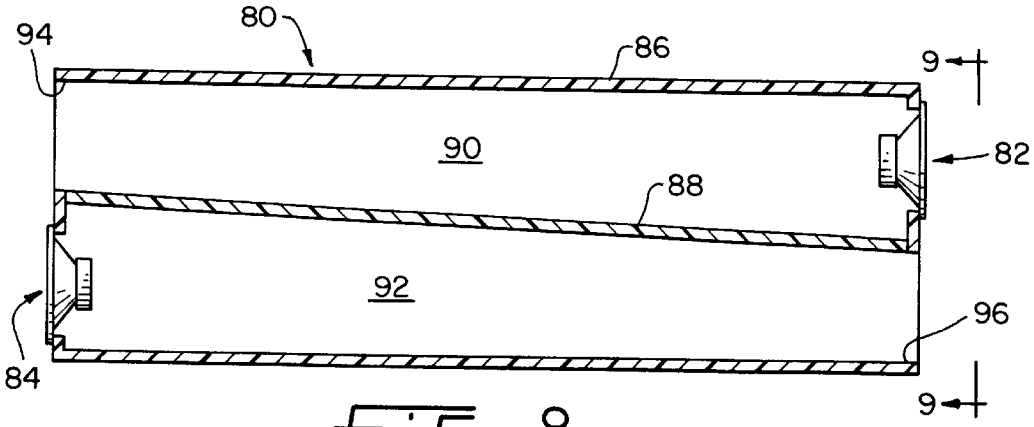
FIG. 8 is a sectional view of a fourth embodiment of the present invention.

FIGS. 8 and 9 show a double speaker embodiment of the present invention. Speaker unit 80 includes low frequency transducers 82 and 84, enclosure 86, and divider wall 88. Enclosure 86 has two interior chambers 90 and 92 defined by divider wall 88. Chamber 90 has transducer 82 acoustically mounted at one end, and has opening 94 located at the other end. Speaker 84 is acoustically mounted in chamber 92 adjacent to opening 94 of chamber 90, and chamber 92 also includes opening 96 opposite transducer 84 and adjacent to transducer 82. By having the transducers mounted adjacent to the other chamber's opening as shown in FIG. 9, the transducer's resonances are lowered. The areas of openings 94 and 96 match the effective cross-sectional areas of the cones of transducers 84 and 82, respectively.

Figure 11:
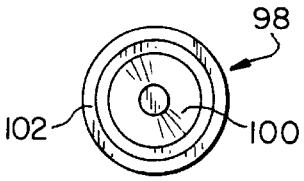
FIG. 11 is a top view taken along view line 11—11 of FIG. 10.
Figure 10:
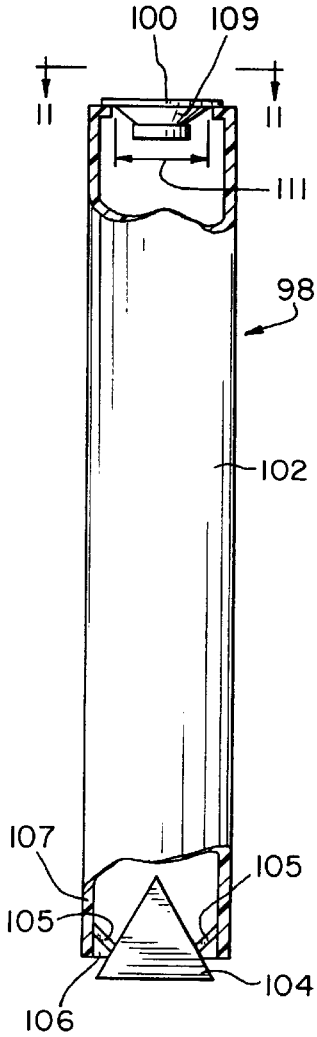
FIG. 10 is an elevational side view, in partial cut-away, of a fifth embodiment of the present invention.

FIGS. 10 and 11 show a vertically disposed embodiment of the present invention. Speaker unit 98 includes low frequency speaker 100, cylindrical enclosure 102, and support 104. Enclosure 102 mounts transducer 100 at its top end and has one opening 106 located at its bottom end. Conical support 104 supports enclosure 102 by means of a plurality of brackets 105 while defining annular opening 106 between it and the cylindrical wall 107 of enclosure 102. The cross-sectional area of annular opening 106 is preferably at least as large as the effective cross-sectional area of speaker cone 109, as indicated by arrow 111 although it can be smaller or larger in some cases.

Figure 13:
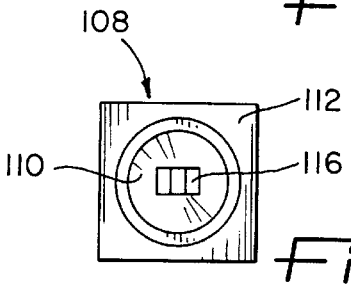
FIG. 13 is a top view taken along view line 13—13 of FIG. 12.
Figure 12:
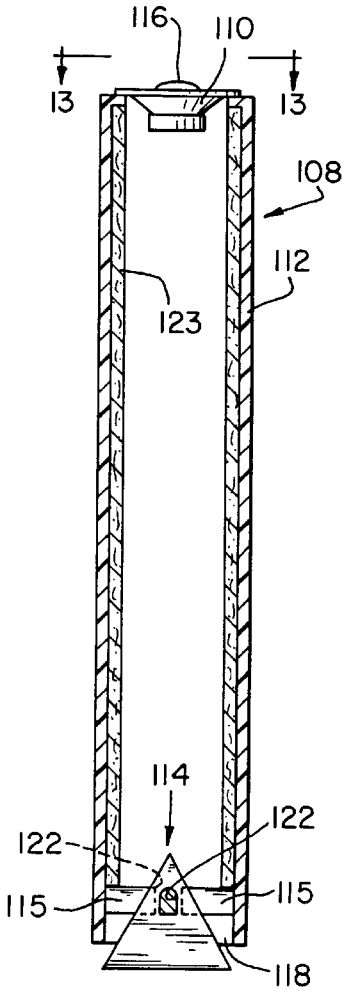
FIG. 12 is a sectional view of a sixth embodiment of the present invention.

FIGS. 12 and 13 show a vertically disposed rectangular embodiment of the present invention. Speaker unit 108 includes low frequency bass transducer 110, rectangular enclosure 112, and pyramid support 114. In this embodiment, transducer 110 also has an additional higher frequency speaker 116 coaxially disposed in the center of midrange/low frequency transducer 110. Enclosure 112 acoustically mounts transducer 110 at its top end and has one annular opening 118 located at its bottom end. Pyramid shaped support 114 is connected to and supports enclosure 112 by means of brackets 115 in the form of rounded rods while defining opening 118 between it and the cylindrical wall of enclosure 112. Support 114 comprises four triangularly shaped refracting surfaces 120 extending upwards into enclosure 112.

Because of the presence of sound waves above approximately 150 cps from transducer 110, the interior wall of enclosure 112 is provided with a layer of sound absorbing material 123 to reduce standing waves. Similarly to the other embodiments, the cross-sectional area of opening 118 should approximate the effective cross-sectional area of the cone of transducer 110.

Figure 14:
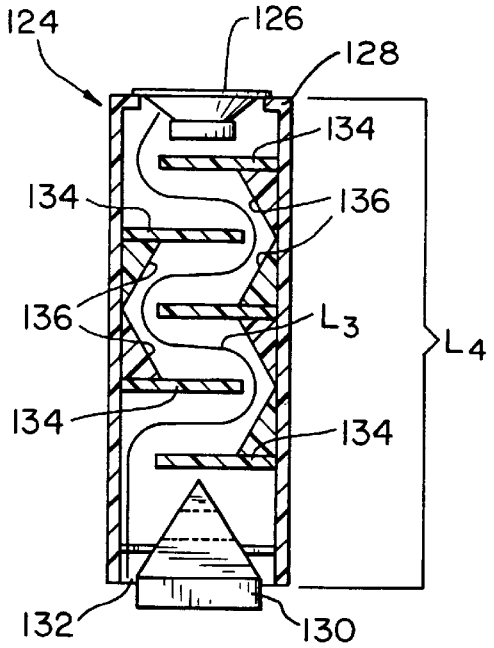
FIG. 14 is a sectional view of a seventh embodiment of the present invention.
Figure 16:
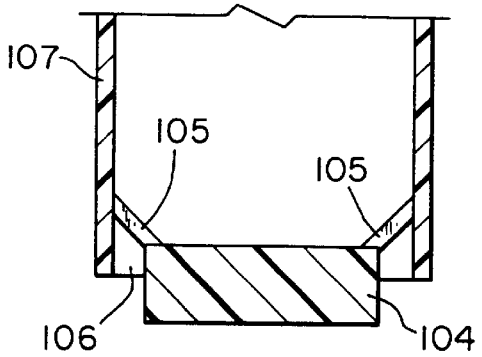
FIG. 16 is an enlarged fragmentary sectional view of FIG. 10.
Figure 17:
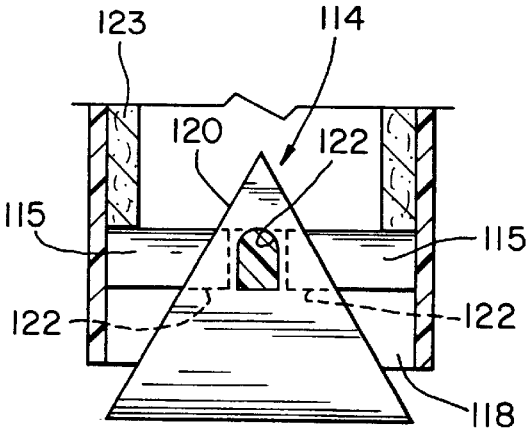
FIG. 17 is an enlarged fragmentary sectional view of FIG. 12.

FIG. 14 is a sectional view of a baffled embodiment of the present invention, with its top view being similar to FIG. 13 but without higher frequency speaker 116. Speaker unit 124 includes low frequency transducer 126, enclosure 128, and pyramid support 130. Enclosure 128 has transducer 126 mounted at its top end, is supported by pyramid support 130 which with enclosure 128 defines one opening 132, and has a plurality of baffles 134 disposed within enclosure 128. Disposed between adjacent baffles 134 are reflectors 136 for channeling sound through a serpentine path within enclosure 128. The serpentine path is labeled L3 in FIG. 14, and extends from the inside of speaker 126, around the plurality of baffles 134, to opening 132. Sound may then traverse exteriorly to enclosure 128 to the outside of speaker 126 along path L4. In accordance with the present invention, the resonating distance of L3+L4 is equal to about one-fourth the wavelength of the desired sound to be produced by speaker 124.

Figure 15:
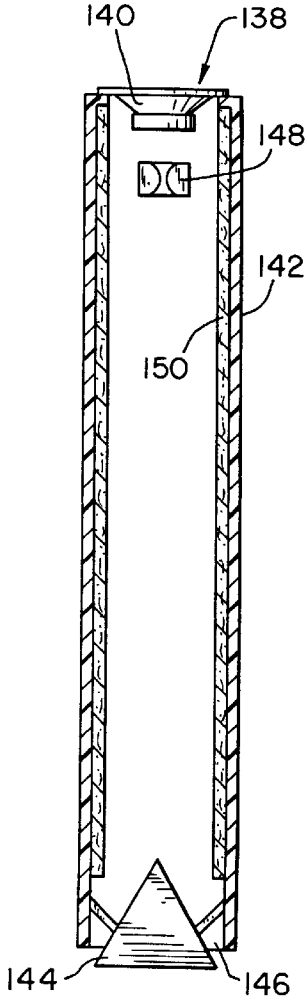
FIG. 15 is a sectional view of an eighth embodiment of the present invention.

FIG. 15 shows a vertical rectangular embodiment of the present invention which includes a tweeter 148, with its top view being similar to FIG. 13 but without higher frequency speaker 116. Speaker unit 138 includes mid frequency/low frequency transducer 140, rectangular enclosure 142, and pyramidal support 144. Enclosure 142 has transducer 140 mounted at its top end, is supported by support 144 which with enclosure 142 defines one opening 146, and has enclosed tweeter 148 disposed within enclosure 142.

Figure 18:
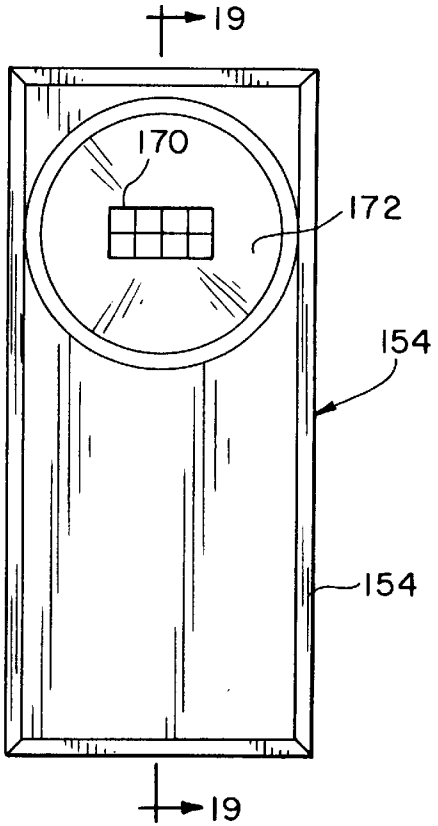
FIG. 18 is a front elevational view of a further embodiment.
Figure 19:
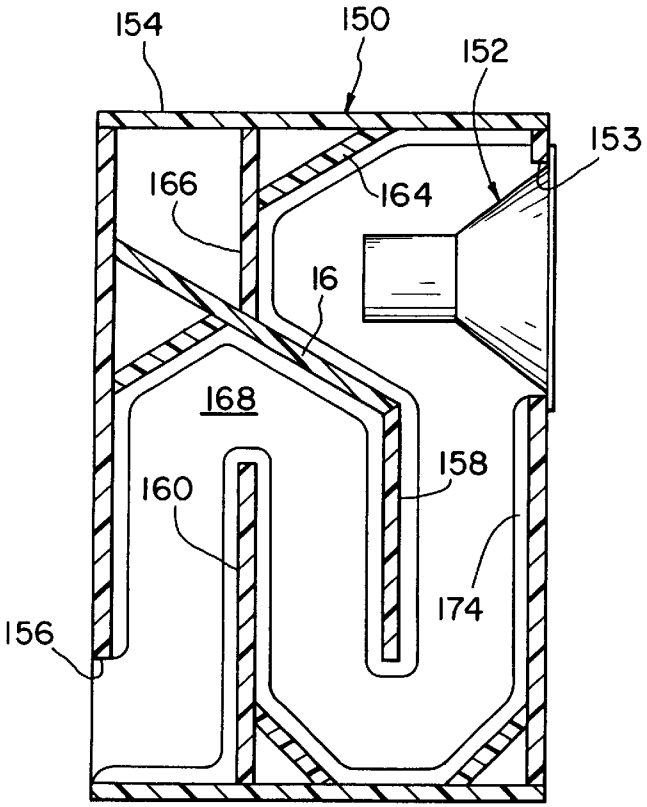
FIG. 19 is a sectional view taken along line 19—19 of FIG. 18.
Figure 20:
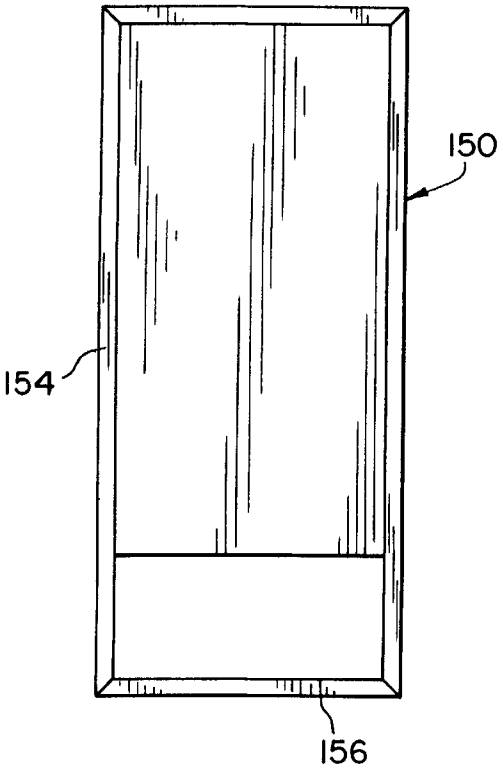
FIG. 20 is a rear elevational view of the embodiment of FIG. 18.

FIGS. 18–20 illustrate a further embodiment of the present invention. Speaker unit 150 includes a low frequency transducer 152 mounted within a front opening 153 of enclosure 154. A rear opening 156 is provided as shown in FIGS. 19 and 20. A plurality of internal baffles such as baffles 158–166 define an internal duct 168 leading from the rear surface of transducer 152 to rear opening 156. The length of internal duct 168 plus the shortest distance from rear opening 156 around the cabinet to the plane defined by front opening 153 is equal to one-fourth of the wavelength of the lowest desired sound to be produced by speaker 150. Transducer 152 is depicted as a coaxial speaker having a horn tweeter 170 mounted in the center of woofer 172. In order to absorb high frequency sounds transmitted rearwardly by horn tweeter 170, the interior duct 168 is lined with sound absorbing material 174.

Figure 21:
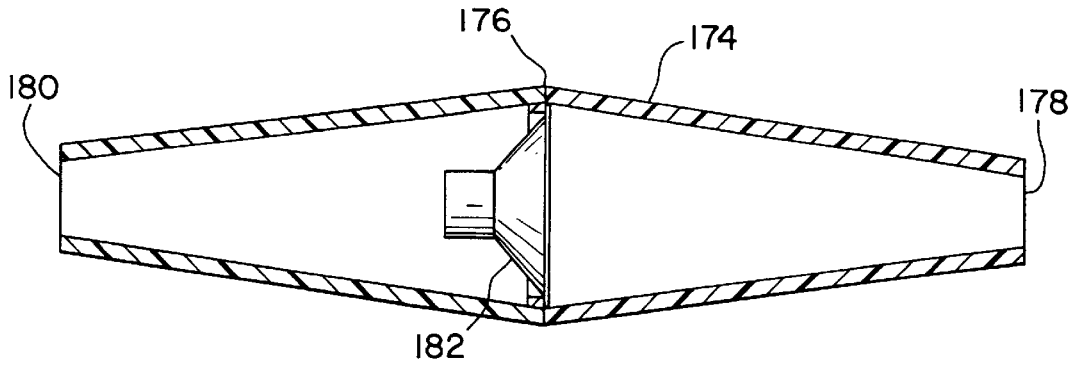
FIG. 21 is a longitudinal sectional view of another embodiment of the present invention.

FIG. 21 illustrates yet another embodiment of the present invention wherein the enclosure 174, which may be circular, rectangular or another cross-sectional shape, tapers inwardly in at least one plane from the median point 176 to the open ends 178 and 180. Transducer 182 is mounted at the median point 176 within enclosure 174 and the distance from the front of transducer 182 to opening 178 is 1/16 of the wavelength of the lowest frequency sound to be produced by transducer 182 and the distance from the rear surface of transducer 182 to opening 180 is similarly 1/16 of the wavelength. Thus, adding together the delay from the front of transducer 182 to the midpoint 176 (1/16+1/16) and the delay from the rear of transducer 182 to the midpoint 176 (1/16+1/16) results in a total delay of one-fourth of the wavelength of the lowest sound to be produced. In this embodiment, enclosure 174 is one-eighth of the wavelength of the lowest sound to be produced.

Figure 22:
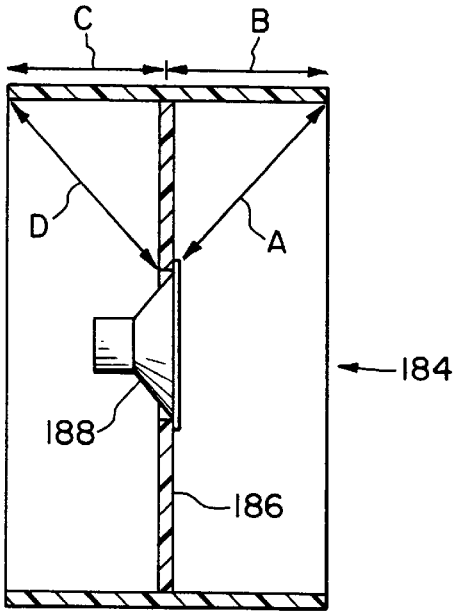
FIG. 22 is a sectional view of another embodiment of the invention.
Figure 23:
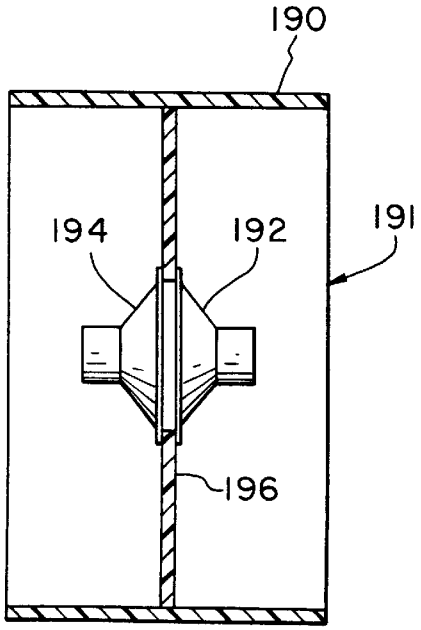
FIG. 23 is a sectional view of yet another embodiment of the invention.

FIG. 23 illustrates a further variation on the speaker 184 shown in FIG. 22 wherein enclosure 190 is constructed similarly to the enclosure of speaker 184 but two matched transducers 192 and 194 are mounted in facing arrangement on central baffle 196. Transducers 192 and 194 are driven 180° out-of-phase. The distance from the rear surface (facing forwardly) of transducer 192 to the front opening of speaker 190 added to the distance from the rear surface (facing rearwardly) of transducer 194 around the enclosure 190 is equal to one-quarter wavelength of the lowest frequency to be produced by speaker 191.

FIG. 23 illustrates a further variation on the speaker 184 shown in FIG. 22 wherein enclosure 190 is constructed similarly to the enclosure of speaker 184 but two matched transducers 192 and 194 are mounted in facing arrangement on central baffle 196. Transducers 194 are driven 180° out-of-phase. The distance from the rear surface (facing forwardly) of transducer 192 to the front opening of speaker 190 added to the distance from the rear surface (facing rearwardly) of transducer 194 around the enclosure 190 is equal to one-quarter wavelength of the lowest frequency to be produced by speaker 191.

Figure 25:
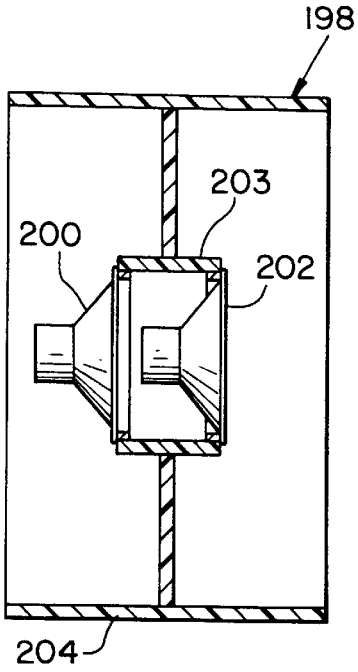
FIG. 25 is a sectional view taken along line 25—25 of FIG. 24.
Figure 24:
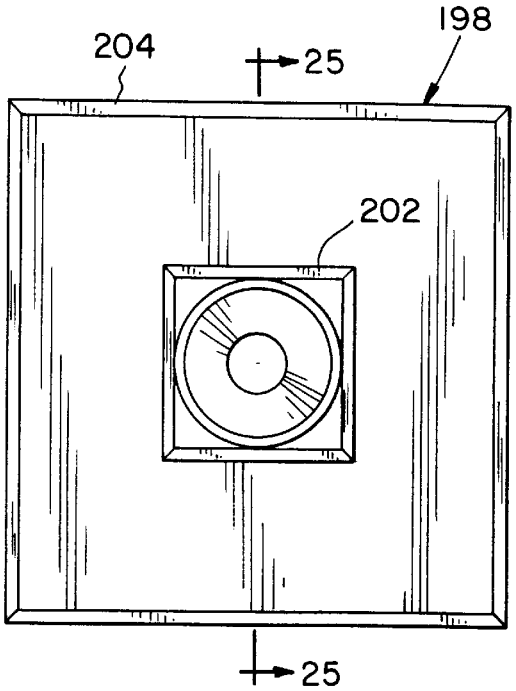
FIG. 24 is a front elevational view of a still further embodiment of the present invention.

The speaker 198 illustrated in FIGS. 24 and 25 is a further variation wherein transducers 200 and 202 are driven in phase and both face forwardly. Transducers 200 and 202 are mounted within enclosure 203 and the sum of the distance from the front of transducer 202 to the midpoint of enclosure 204 and the distance from the rear surface of transducer 200 to the midpoint of enclosure 204 is equal to one-quarter wavelength.

Figure 26:
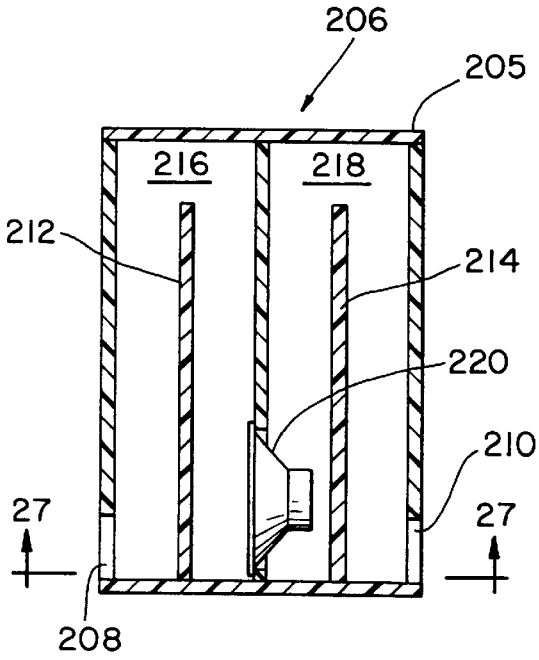
FIG. 26 is a sectional view of a further embodiment of the present invention.
Figure 28:
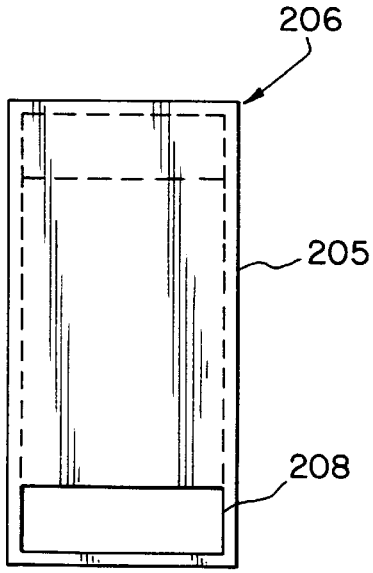
FIG. 28 is a front elevational view of the embodiment of FIG. 26.
Figure 27:
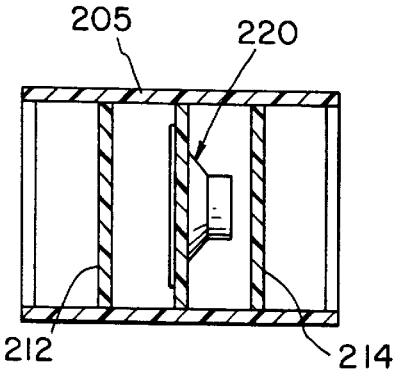
FIG. 27 is a view taken along line 27—27 of FIG. 26.

FIGS. 26–28 illustrate an alternative enclosure arrangement wherein the enclosure 205 for speaker 206 includes front opening 208, rear opening 210 and a pair of rectangular internal baffles 212 and 214 that form internal ducts 216 and 218, respectively. Once again, the combined distance from the front of transducer 220 through opening 208 to the midpoint of enclosure 205 and from the rear of transducer 220 through opening 210 to the midpoint of enclosure 205 is equal to one-fourth of the wavelength of the lowest frequency sound to be produced by speaker 206.

Figure 29:
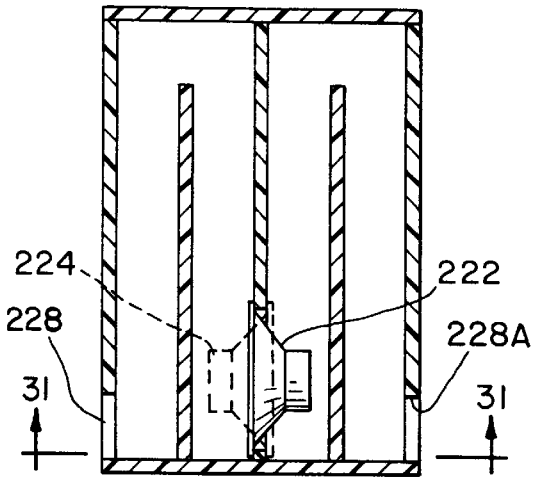
FIG. 29 is a sectional view of yet another embodiment of the invention.
Figure 30:
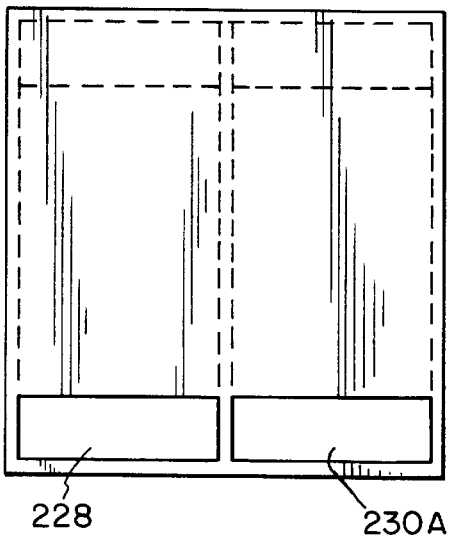
FIG. 30 is a rear elevational view of the embodiment of FIG. 29.
Figure 31:
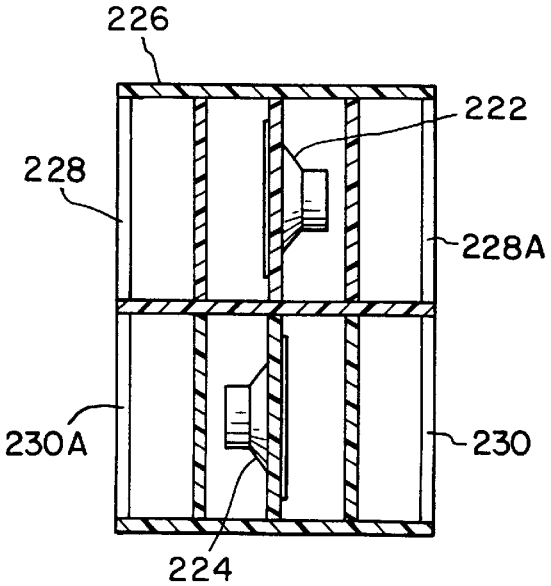
FIG. 31 is a view taken along line 31—31 of FIG. 29.

FIGS. 29–31 show a modification of the speaker 206 of FIGS. 26–28 wherein two transducers 222 and 224 are mounted on respective sides of enclosure 226 and face in opposite directions. Opening 230A is the rear opening for transducer 224 and opening 230 is the front opening for transducer 224. Opening 228 is the front opening for transducer 222 and opening 228A is the rear opening therefor.

Figure 32:
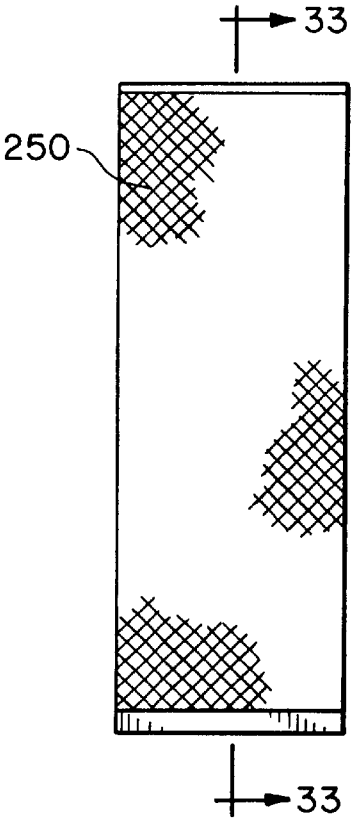
FIG. 32 is a rear elevational view of a further embodiment of the invention.
Figure 33:
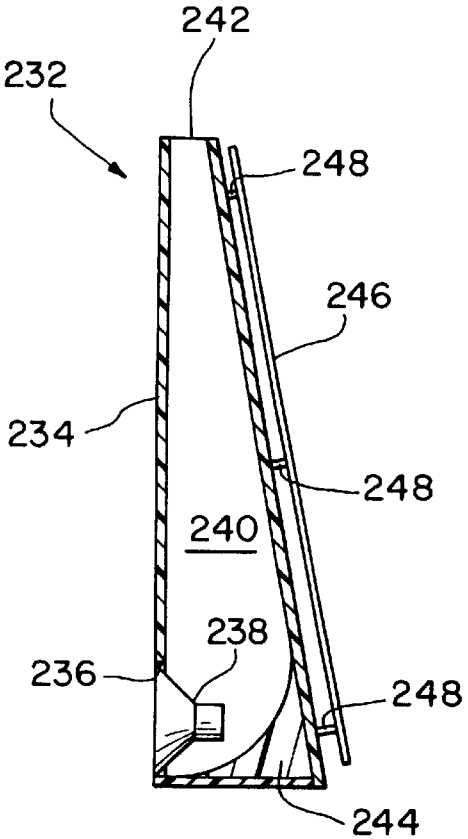
FIG. 33 is a sectional view taken along line 33—33 of FIG. 32.

FIGS. 32 and 33 illustrate an embodiment of the invention incorporating an electrostatic'speaker panel. Speaker 232 comprises an enclosure 234 having an opening 236 in which is mounted transducer 238 which could be, for example, a 12 inch woofer. Enclosure 234 defines an interior duct 240 that is tapered from the low end thereof at the position where transducer 238 is mounted to the upper opening 242, and includes a reflector 244 made of styrofoam or other appropriate material to channel the soundwaves upwardly through duct 240. By way of example, enclosure 234 could have a height of 72 inches and a depth of 18 inches, and the effective length of internal duct 240 is one-eighth wavelength so that this system therefore will produce bass sounds to 27 hertz.

A conventional electrostatic speaker panel 246 is mounted to the front surface of enclosure 234 by means of a plurality of standoffs and may be covered with a grill cloth 250. Electrostatic speaker panels provide excellent high, midrange, and high bass reproduction in the range of approximately 100 hertz to inaudibility and the sub-woofer 238 would generate bass sound below 100 hertz, down to 27 hertz and below. A cross-over would be provided between sub-woofer 238 and electrostatic speaker 246.

Figure 34:
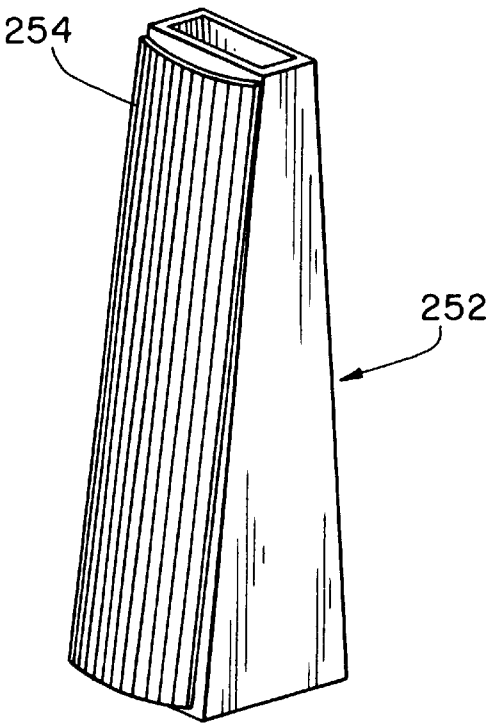
FIG. 34 is a perspective view of the modification of the speaker shown in FIGS. 32 and 33.

FIG. 34 illustrates a speaker 252 that is substantially identical to speaker 232 (FIG. 33) except that electrostatic panel 254 is curved.

Figure 35:
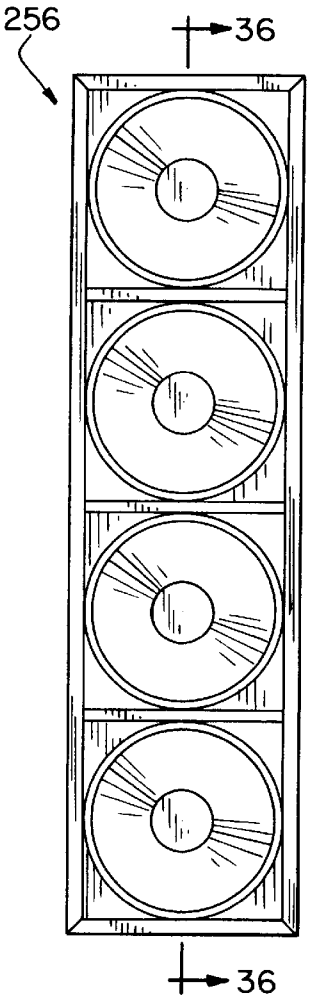
FIG. 35 is a front elevational view of yet another embodiment of the invention.
Figure 36:
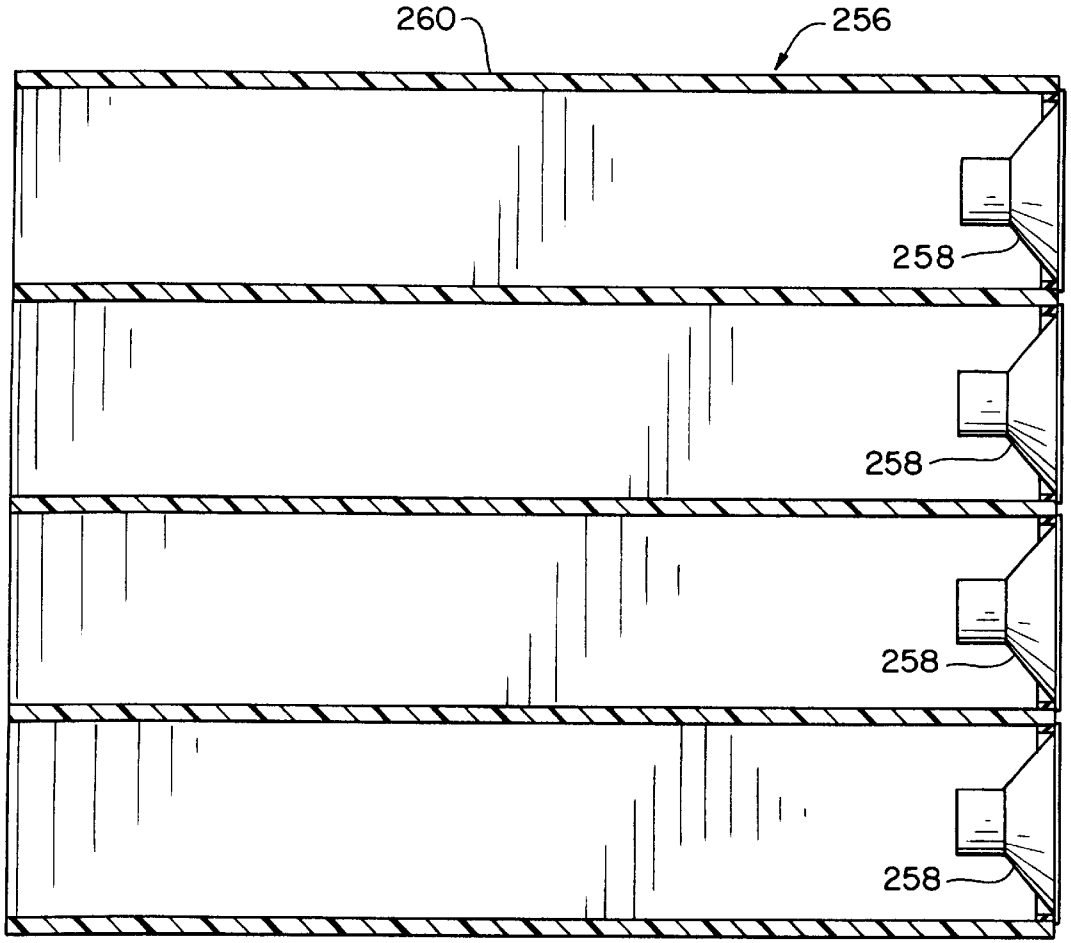
FIG. 36 is a sectional view taken along line 36—36 of FIG. 35.

FIGS. 35 and 36 show a multiple stacked transducer speaker 256 wherein transducers 258 are mounted in front openings of enclosure 260. The axial dimensional characteristics are the same as discussed in connection with the speaker of FIGS. 1 and 2.

Figure 37:
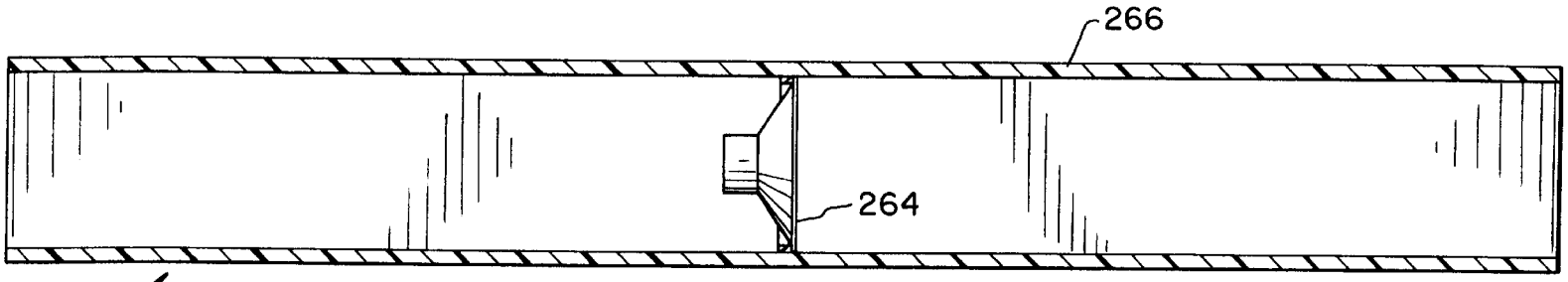
FIG. 37 is a longitudinal sectional view of a further embodiment.

FIG. 37 illustrates a speaker 262 similar to speaker 20 shown in FIG. 1 but wherein transducer 264 is mounted at the midpoint of enclosure 266. The dimensions of enclosure 266 are the same as those discussed in connection with the speaker of FIGS. 1 and 2.

Figure 39:
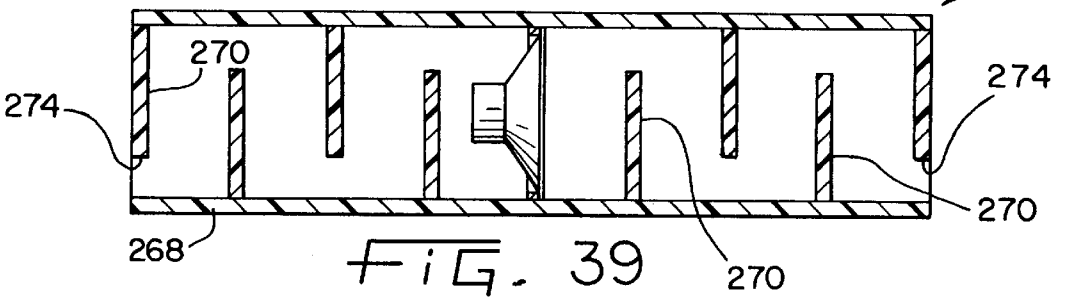
FIG. 39 is a longitudinal sectional view of yet a further embodiment of the invention.
Figure 40:
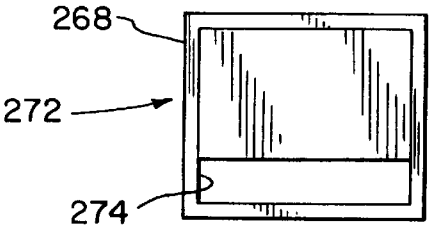
FIG. 40 is an end view of the speaker shown in FIG. 39.
Figure 38:
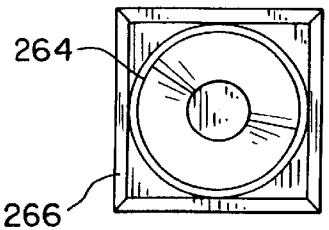
FIG. 38 is an end view of the speaker shown in FIG. 37.

FIG. 39 illustrates a modification to speaker 262 of FIG. 37 wherein the length of enclosure 268 is one-half the length of enclosure 266 and includes a plurality of internal baffles 270 that lengthens the acoustic length of speaker 272 internally within enclosure 268 to match the acoustic length of speaker 262. The sound is emitted through openings 274.

Figure 41:
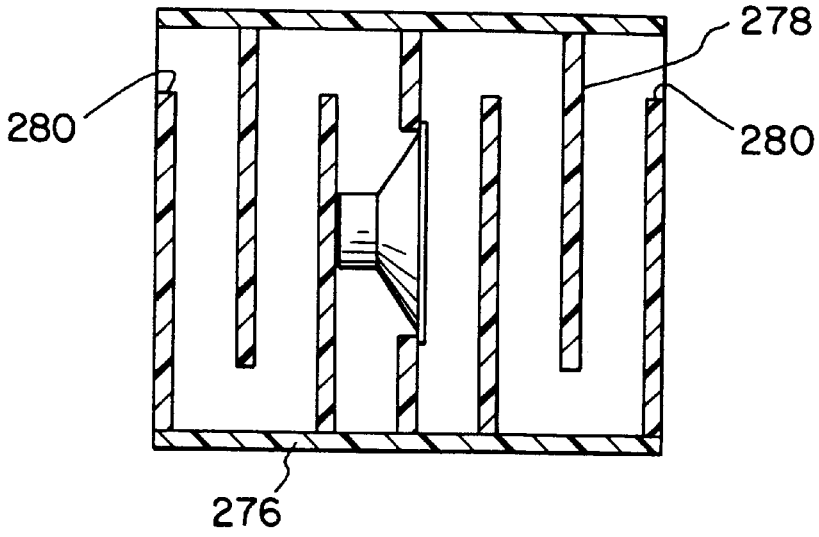
FIG. 41 is a longitudinal sectional view of another embodiment of the invention.
Figure 42:
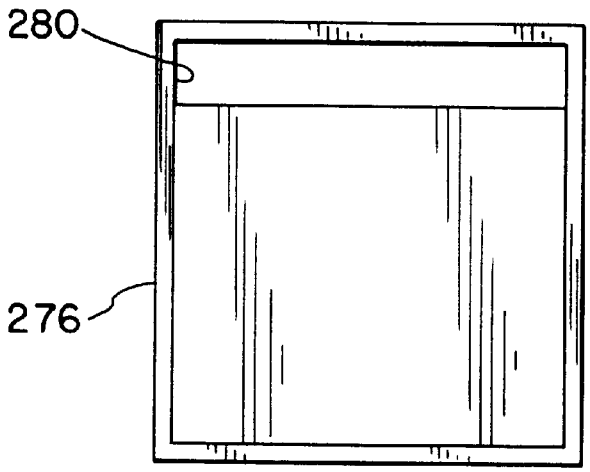
FIG. 42 is an end view of the speaker shown in FIG. 41.

FIG. 41 is a modification of the speaker 272 of FIG. 39 wherein the length of enclosure 276 has been further shortened to be approximately 33% of the length of enclosure 268, and which includes internal baffles 278 that provide an acoustic length that is identical to that of speakers 262 and 272 (FIGS. 37 and 39). Sound is emitted through openings 280.

Figure 43:
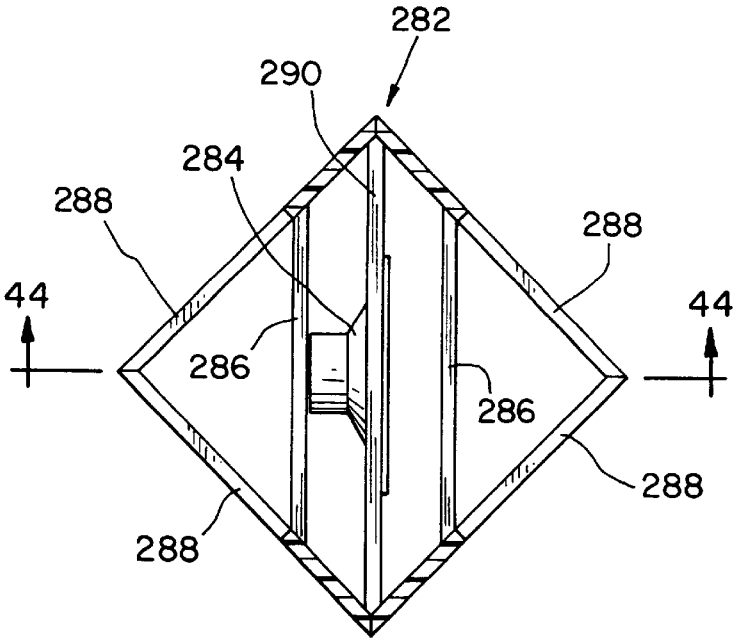
FIG. 43 is a sectional view of yet another embodiment of the invention.
Figure 44:
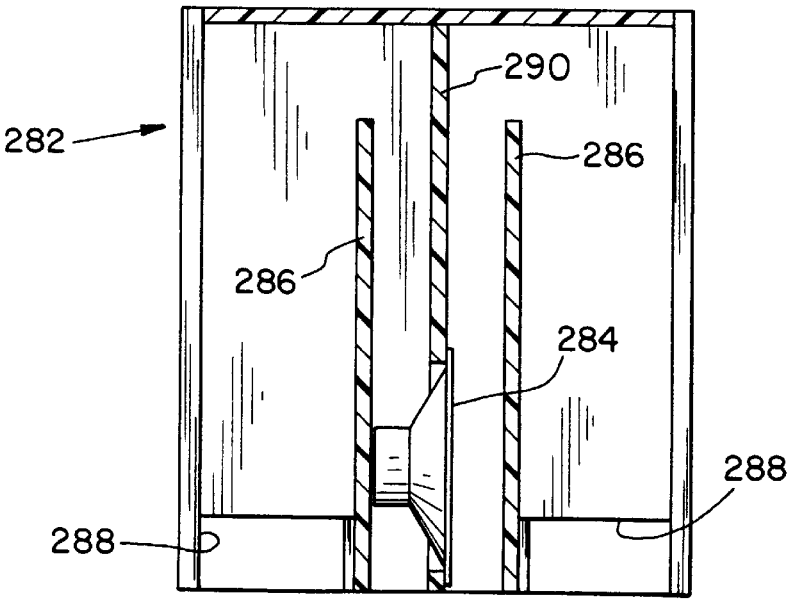
FIG. 44 is a sectional view taken along line 44—44 of FIG. 43 and viewed in the direction of the arrows.

The speaker 282 shown in FIGS. 43 and 44 is similar to the speaker shown in FIG. 29 except that the mounting of transducer 284 and internal baffles 286 have been rotated 45°. The sound is emitted through openings 288. Transducer 284 is mounted to center panel 290.

The enclosures described above can be made of conventional materials, such as particle board, PVC or other plastics, metal, styrofoam, laminate, or other more or less nonresonating material, and the transducers are conventional in nature and can be purchased commercially from a variety of suppliers. The effective vibrating area of the transducer cone is a projection of the cone onto a plane that is perpendicular to the axis defined by the cone of the transducer. In other words, the effective vibrating area is essentially the area defined by the diameter of the face of the transducer cone. The transducer can take any suitable form including coaxial, triaxial, etc.

While this invention has been described as having a preferred design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A speaker system for use in an audio system to reproduce low frequency sounds, said speaker system comprising:

a low frequency transducer for reproducing sounds in a low frequency band;

a filter for blocking signals to said transducer that are higher than about 150 hertz in frequency; and an elongate linear enclosure defining an interior duct having first and second ends, said low frequency transducer being acoustically mounted in said enclosure with a front vibrating surface facing exteriorly of said enclosure toward said first end and a rear vibrating surface facing said interior duct, said first end having an opening therein adapted to allow sound produced by the front vibrating surface of said transducer to pass therethrough, said second end having an opening therein adapted to allow sound produced by the rear vibrating surface of said transducer to pass therethrough, the acoustic length of said duct being approximately one-eighth the length of the wavelength of the lowest frequency sound to be produced by said low frequency transducer;

said interior duct being substantially open to thereby permit the low frequency acoustic waves produced by said vibrating surfaces to pass through said interior duct and said openings substantially unattenuated and undelayed.

2. The speaker system of claim 1 wherein said enclosure is generally cylindrical in transverse cross-section.

3. The speaker system of claim 1 wherein said enclosure is generally rectangular in transverse cross-section.

4. The speaker system of claim 1 wherein said enclosure is generally horizontally disposed.

5. The speaker system of claim 1 wherein said enclosure is generally vertically disposed.

6. The speaker system of claim 1 wherein said transducer is mounted at said first end and faces outwardly from said first end in an axial direction.

7. The speaker system of claim 1 wherein said transducer faces in a direction transverse to the longitudinal axis of said enclosure.

8. The speaker system of claim 1 further comprising a second transducer for reproducing sound in a frequency band higher than 150 hertz, said second transducer located in said interior duct of said enclosure, and said interior duct includes a layer of sound absorbing material on an inner wall of said enclosure for absorbing said higher frequency sound.

9. The speaker system of claim 1 wherein said enclosure further comprises an elongate divider wall extending axially and defining first and second elongate chambers in said interior space, and a second low frequency transducer for reproducing sound in said low frequency band, wherein said first chamber includes said opening and said first low frequency transducer is disposed in said first chamber, said second chamber includes a second opening and said second low frequency transducer is disposed in said second chamber, and the distance between each of said low frequency transducers and the respective one of said openings is approximately one-eighth the length of the wavelength of the lowest frequency sound to be produced.

10. The speaker system of claim 9 wherein said first and second transducers are at opposite ends of said enclosure.

11. The speaker system of claim 1 wherein said second end opening is generally annular.

12. The speaker system of claim 11 including a reflector adjacent said annular opening for directing acoustic waves from the rear vibrating surface of the speaker through said annular opening.

13. The speaker system of claim 1 wherein said filter means blocks signals that are higher than about 75 hertz in frequency.

14. The speaker system of claim 1 wherein said filter means blocks signals that are higher than about 50 hertz in frequency.

15. The speaker system of claim 1 wherein said transducer is mounted substantially at an axial midpoint of said enclosure.

16. The speaker system of claim 15 wherein said enclosure tapers inwardly from said midpoint to said first and second ends.

17. The speaker system of claim 1 wherein said enclosure tapers inwardly from the position where said transducer is mounted to said first end.

18. The speaker system of claim 1 and further including: an electrostatic speaker panel mounted to an exterior surface of said enclosure; and a crossover network channeling lower frequency bass signals to said transducer and higher frequency bass signals to said electrostatic speaker panel.

19. A speaker system for use in an audio system to reproduce low frequency sounds, said speaker system comprising:

a low frequency transducer for reproducing sounds in a low frequency band;

a filter for blocking signals to said transducer that are higher than about 150 hertz in frequency; and an enclosure defining an interior space having first and second ends having first and second openings, respectively, said low frequency transducer being acoustically mounted in said interior space with a front vibrating surface facing toward said first opening and a rear vibrating surface facing said interior space toward said second opening adapted to allow sound produced by the rear vibrating surface of said transducer to pass through, said second opening facing a direction different from the direction in which said first opening faces and being in a plane different from the plane of said first opening, said enclosure having at least one internally disposed baffle for channeling the low frequency sounds, said baffle defining a serpentine path in said enclosure interior space from said transducer to said opening, the acoustic distance from said rear vibrating surface through said space to said front vibrating surface being approximately one-fourth of the length of the wavelength of the lowest frequency sound to be produced by said low frequency transducer, and wherein said serpentine path is less than said one-fourth the length of said wavelength;

said interior space being substantially open to thereby permit the low frequency acoustic waves produced by said rear vibrating surface to pass through said interior space and said second opening substantially unattenuated and undelayed.

20. The speaker system of claim 19 wherein said transducer is mounted in said serpentine path at substantially an acoustic midpoint in said serpentine path between said first and second openings.

21. The speaker system of claim 20 wherein said at least one baffle is disposed between said transducer and said first opening, and including a second baffle disposed between said transducer and said second opening.

22. The speaker system of claim 19 wherein said at least one baffle is disposed between said transducer and said first opening, and including a second baffle disposed between said transducer and said second opening.

23. The speaker system of claim 19 including:

a second low frequency transducer for reproducing sounds in a low frequency band;

a second filter for blocking signals to said second transducer that are higher than about 150 hertz in frequency;

a second enclosure defining a second interior space having third and fourth ends having third and fourth respective openings, said second transducer being acoustically mounted in said second interior space with a front vibrating surface facing toward said third opening and a rear vibrating surface facing toward said fourth opening, the acoustic distance from said rear vibrating surface of said second transducer through said second interior space to said front vibrating surface of said second transducer being approximately one-fourth of the length of said wavelength.

24. The speaker system of claim 23 wherein said first and fourth openings face in the same direction as each other and said second and third openings face in the same direction as each other.

25. The speaker system of claim 24 wherein said first and fourth openings are substantially coplanar and said second and third openings are substantially coplanar.

26. The speaker system of claim 19 wherein said transducer is mounted in said first opening.

27. A speaker system for use in an audio system to reproduce low frequency sounds, said speaker system comprising:

a low frequency transducer for reproducing sounds in a low frequency band;

a filter for blocking signals to said transducer that are higher than about 150 hertz in frequency; and an enclosure defining a non-linear interior duct having first and second ends having respective first and second openings;

said first transducer being mounted in said duct and having a front vibrating surface facing toward said first opening and a rear vibrating surface facing toward said second opening;

said duct being substantially open to thereby permit the low frequency sounds produced by said rear vibrating surface to pass through said duct toward said second opening substantially unattenuated and undelayed;

said first and second openings being in substantially different planes;

the acoustic distance from said rear vibrating surface through said duct to said front vibrating surface being approximately one-fourth of the length of the wavelength of the lowest frequency sound to be produced by said transducer, said duct having an acoustic length less than one-fourth of said wavelength.

28. The speaker system of claim 27 further comprising a second transducer for reproducing sound in a frequency band higher than 150 hertz, said second transducer located in said interior duct of said enclosure, and said interior duct includes a layer of sound absorbing material on an inner wall of said enclosure for absorbing said higher frequency sound.

29. The speaker system of claim 27 wherein said first opening and said second opening face opposite directions.

30. The speaker system of claim 27 wherein said transducer is mounted in said duct at substantially an acoustic midpoint in said duct between said first and second openings.

* * * * *